US010543431B2

(12) United States Patent
Muraki et al.

(10) Patent No.: US 10,543,431 B2
(45) Date of Patent: Jan. 28, 2020

(54) SPINNING TOP TOY

(71) Applicant: TOMY Company, Ltd., Tokyo (JP)

(72) Inventors: Makoto Muraki, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/991,358

(22) Filed: May 29, 2018

(65) Prior Publication Data

US 2018/0361261 A1 Dec. 20, 2018

(30) Foreign Application Priority Data

Jun. 16, 2017 (JP) ..... 2017-118297

(51) Int. Cl.
*A63H 1/00* (2019.01)
*A63H 1/18* (2006.01)
*A63H 1/02* (2006.01)

(52) U.S. Cl.
CPC ..... *A63H 1/02* (2013.01)

(58) Field of Classification Search
CPC ..... A63H 1/02; A63H 1/04
USPC ..... 446/4, 256, 257, 263
See application file for complete search history.

(56) References Cited

U.S. PATENT DOCUMENTS 253,702 A * 2/1882 Hill
2,739,415 A * 3/1956 Roberton ..... A63H 1/00 446/263
4,030,238 A * 6/1977 Lakin ..... A63H 13/04 446/36
4,204,359 A * 5/1980 Plo ..... A63H 27/12 446/41
4,304,064 A * 12/1981 Kulesza ..... A63H 1/06 446/241
4,772,241 A * 9/1988 Bro ..... A63H 1/08 446/202
5,827,107 A * 10/1998 Bears ..... A63H 1/20 446/263
6,364,734 B1 * 4/2002 Ng ..... A63H 1/00 446/236
2014/0302743 A1 * 10/2014 Cai ..... A63H 1/18 446/256
2016/0228777 A1 * 8/2016 Cai ..... A63H 1/02

FOREIGN PATENT DOCUMENTS

JP 5793631 B1 10/2015

* cited by examiner

*Primary Examiner* — Nini F Legesse
(74) *Attorney, Agent, or Firm* — IP Business Solutions, LLC

(57) ABSTRACT

A spinning top toy includes a braking member, a shaft part which is configured to be rotated, and a body which is detachably attached to the shaft part. The body is configured to be detached from the shaft part by being rotated with respect to the shaft part. When an impact is applied to the body, the braking member is configured on one of the shaft part and the body and is movable by a centrifugal force. When urged by the centrifugal force, the braking member is configured to become in contact with the other of the shaft part and the body.

5 Claims, 7 Drawing Sheets

SPINNING TOP TOY

CROSS-REFERENCE TO RELATED APPLICATIONS

The present application claims priority under 35 U.S.C. 119 to Japanese Patent Application No. 2017-118297, filed on Jun. 16, 2017. The contents of this application are incorporated herein by reference in their entirety.

BACKGROUND OF THE INVENTION

Field of the Invention

The present invention relates to a spinning top toy.

Description of the Related Art

As battle games using spinning top toys, by applying impact to the spinning top toys each other, there are cases in which the rotation of the spinning top toy of an opponent is stopped by the impact force, the spinning top toy of the opponent is flicked out by the impact force, or the spinning top toy of the opponent is disassembled by the impact force, etc.

As such type of the spinning top toy, for example, a spinning top toy described in Japanese Patent No. 5793631 is well known.

In this spinning top toy, a shaft part and a body are aligned at a disassembled position in the vertical direction, and in an aligned state, a body is relatively rotated with respect to a shaft part in one direction to an assembled position, so that hooks in a shaft part side and hooks in a body side are engaged and the shaft part and the body are coupled. In this spinning top toy, when the body of the spinning top toy collides with the opponent, the body is rotated in the other direction with respect to the shaft part, so as to be disassembled. Therefore, the shaft part and the body are disassembled.

Further, in this spinning top toy, in order not to disassemble the shaft part and the body by receiving impact easily, a rotation resistance is provided between the shaft part and the body, so that it is configured to gradually rotate the body with respect to the shaft part every time when the impact is received.

However, according to such spinning top toy, during battle games, without issues in which the rotational speed changes, offensive power and defense power are uniform, so that there are problems such as a lack of changes of the offensive power and the defense power and a lack of unexpectedness.

The description herein of advantages and disadvantages of various features, embodiments, methods, and apparatus disclosed in other publications is in no way intended to limit the present invention. For example, certain features of the preferred described embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The disclosed embodiments of the present invention have been developed in view of the above-mentioned and/or other problems in the related art. The disclosed embodiments of the present invention can significantly improve upon existing methods and/or apparatuses.

The present invention was created considering the aforementioned problems. An object is to provide a spinning top toy to change offense and defense characteristics during a rotation.

In some embodiments of the present disclosure, a spinning top toy includes a braking member; a shaft part being configured to be rotated; and a body being detachably attached to the shaft part. The body is configured to be detached from the shaft part by being rotated with respect to the shaft part. When an impact is applied to the body, the braking member is configured on one of the shaft part and the body and is movable by a centrifugal force. When urged by the centrifugal force, the braking member is configured to become in contact with the other of the shaft part and the body.

In some embodiments of the present disclosure, the body is gradually rotated with respect to the shaft part by receiving the impact.

In some embodiments of the present disclosure, the body is configured to be detached from the shaft part when rotated in first direction, and the body is assembled to the shaft part when rotated in a second direction opposite to the first direction.

In some embodiments of the present disclosure, the braking member extends outwardly in a radial direction, and the braking member is configured to be in contact with an opponent spinning top toy when the spinning top toy is rotated.

In some embodiments of the present disclosure, the braking member is movable in a direction away from the one of the shaft part and the body, and the braking member becomes in contact with other of the shaft part or the body when moved in the direction.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims. In the drawings, the size and relative sizes of layers and regions may be exaggerated for clarity. Like numbers refer to like elements throughout. The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". It will be understood that, although the terms first, second, etc. may be used herein to describe various elements, these elements should not be limited by these terms. Unless indicated otherwise, these terms are only used to distinguish one element from another. For example, a first object could be termed a second object, and, similarly, a second object could be termed a first object without departing from the teachings of the disclosure. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct contact (i.e., touching) unless the context indicates otherwise. Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

BRIEF DESCRIPTION OF THE DRAWINGS

FIG. 10(A) is a side cross-sectional view showing a state before the operation.

FIG. 10(B) is a side cross-sectional view showing a state after the operation.

DETAILED DESCRIPTION

In the following paragraphs, some embodiments of the invention will be described by way of example and not limitation. It should be understood based on this disclosure that various other modifications can be made by those in the art based on these illustrated embodiments.

Hereinafter, a spinning top toy of the present invention will be described based on embodiments shown the drawings.

<Whole Structure>

Figure 1:
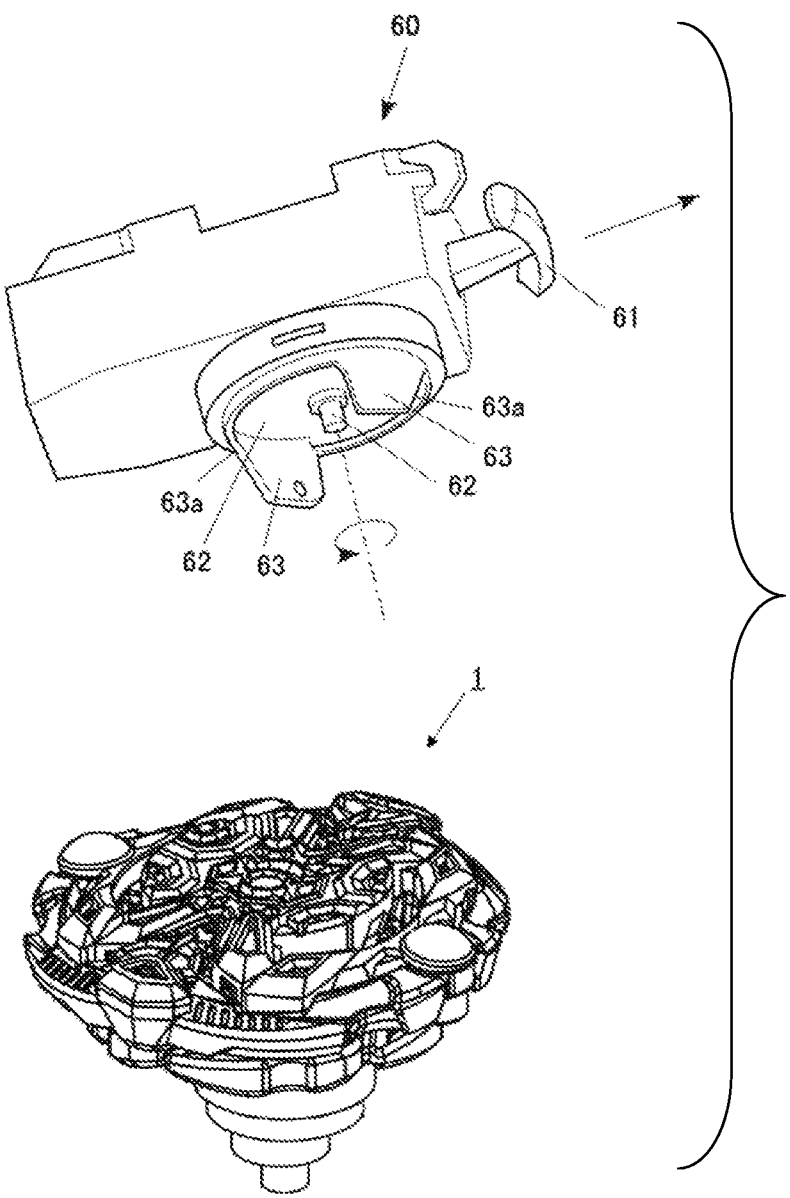
FIG. 1 is a perspective view showing a spinning top toy and a launcher (spinning top toy launcher) according to an embodiment.

FIG. 1 shows a toy set including a spinning top toy 1 of the present embodiment and a launcher 60 (spinning top toy launching toy).

Among these toys, the spinning top toy 1 is a spinning top toy which can be used for, so called, battle games. For example, the spinning top toys 1 can be used for the battle games in which the spinning top toys 1 collide each other and the spinning top toy 1 of the opponent is disassembled by the impact force as shown in FIG. 2.

Figure 2:
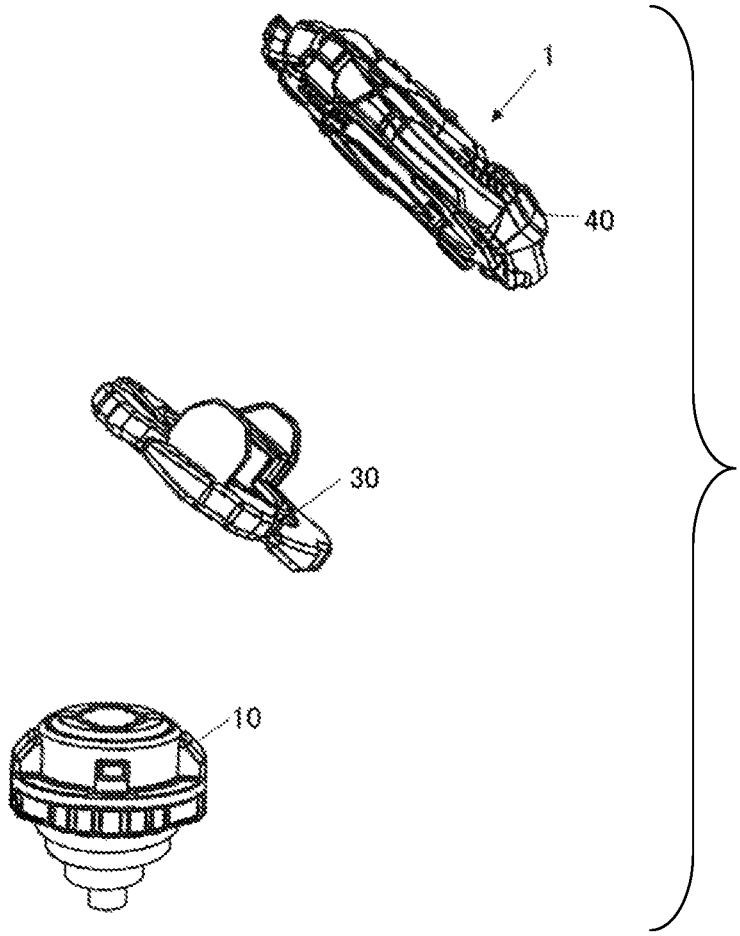
FIG. 2 is a perspective view explaining how to play with the spinning top toy according to the present embodiment.

As shown in FIG. 2, the spinning top toy 1 is configured with a shaft part 10, a flywheel 30, and a body 40.

<Detail Structure>

1. Shaft Part 10

Figure 3:
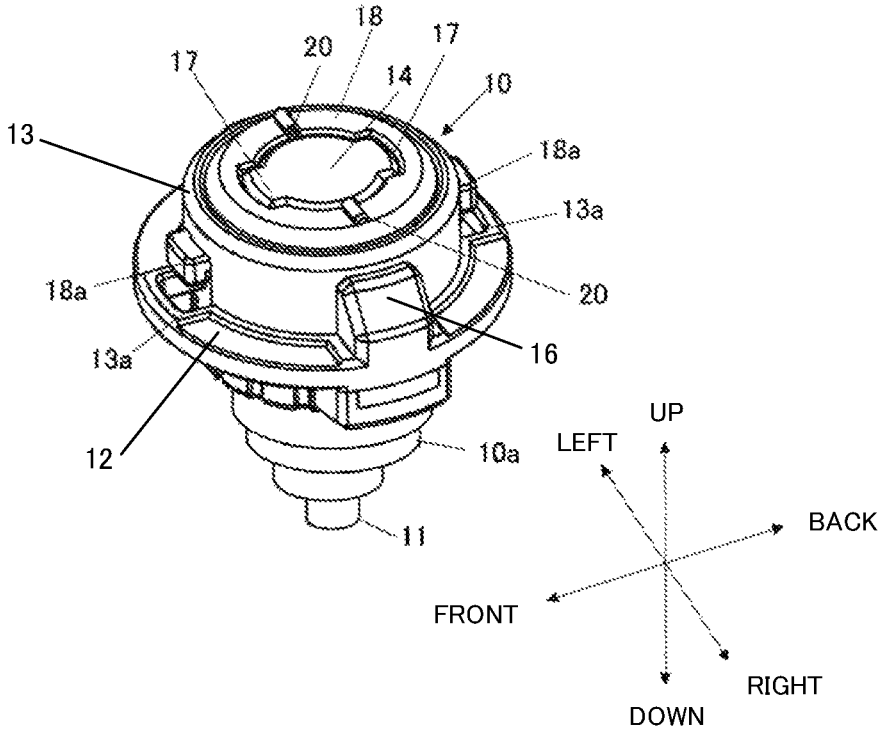
FIG. 3 is a perspective view showing a shaft part of the spinning top toy according to the present embodiment.

FIG. 3 is a perspective view showing the shaft part 10. In the explanation of the shaft part 10, the terms "up", "down", "left", "right", "front", and "back" refer to the corresponding directions in FIG. 3.

Among the parts, the shaft part 10 is provided with a rotating shaft 11, which is a grounding part and positioned at a lower end part, a flange 12 which is an intermediate part in the vertical direction, and a cylindrical body 13 which is positioned in an upper end part.

The flange 12 and the cylindrical part 13 are integrally formed. A cylinder 14 is provided in the shaft of the cylindrical body 13. The upper end part of the cylinder 14 is made larger in diameter (and thus defined as a large diameter portion), and an overhanging hook 17 projects outwardly in a radial direction in each of the front and back in the outer periphery of the large diameter portion. The cylinder 14 is fixedly provided in a shaft lower part 10*a*. The outer periphery surface of the shaft lower part 10*a* is gradually reduced in diameter in the direction from the flange 12 side to the tip end side of the rotating shaft 11, so as to form substantially a reversed conical shape as a whole. The shaft lower part 10*a* is fastened to the flange 12 by a screw, etc. which is not shown in the drawings.

In each of the front and back of the flange 12 and the cylindrical body 13, a hole 13*a* is formed throughout the flange 12 and the cylindrical body 13. Further, in each of the right and left of the outer periphery surface of the cylindrical body 13, a projection part 16 is formed. The outer periphery surface of each projection part 16 shares a plane with the outer periphery surface of the flange 12.

Figure 10:
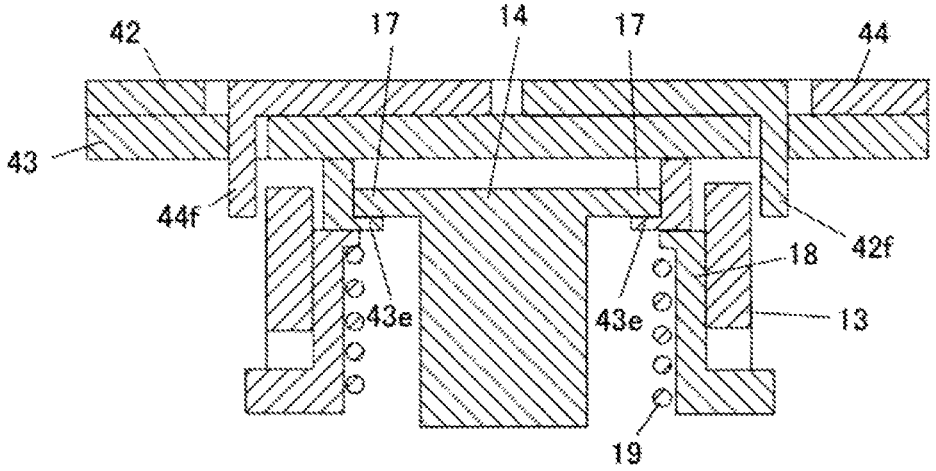
FIG. 10(A) shows the braking member of the spinning top toy according to the present embodiment.
FIG. 10(B) shows the braking member of the spinning top toy according to the present embodiment.
Figure 10:
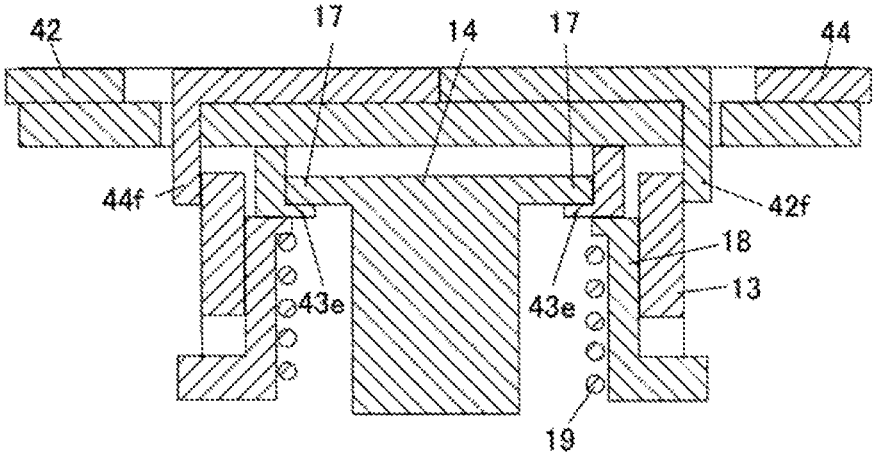

Further, the shaft part 10 is provided with a cylindrical shape urging member 18 (see FIGS. 10(A) and 10(B)). The urging member 18 has an annular top plate which is the shape fitting to the outside of the upper end part of the cylinder 14, and the inner part is hollow and opening downwardly. The urging member 18 is arranged inside the cylinder 14 to surround the cylindrical body 13. In each of the front and back of the outer periphery of the lower end part of the urging member 18, a leg part 18*a* is formed and stretches outwardly in a radial direction.

As shown in FIG. 3, the urging member 18 is installed so as to expose leg parts 18*a* from the holes 13*a* which correspond to the leg parts 18*a*. The holes 13*a* allow the movement of the leg parts 18*a* in the vertical direction, but the movement is restricted at the upper end of the holes 13*a*. Further, the urging member 18 is urged in the upper direction by the spring 19, and in a normal condition, the top end surface of the urging member 18 is positioned at the same height as the top end of the cylindrical part 13.

Further, in each of right and left of the upper surface of the urging member 18, protruding strips (projections) 20, which extend in the radial direction, are formed.

2. Flywheel 30

Figure 4:
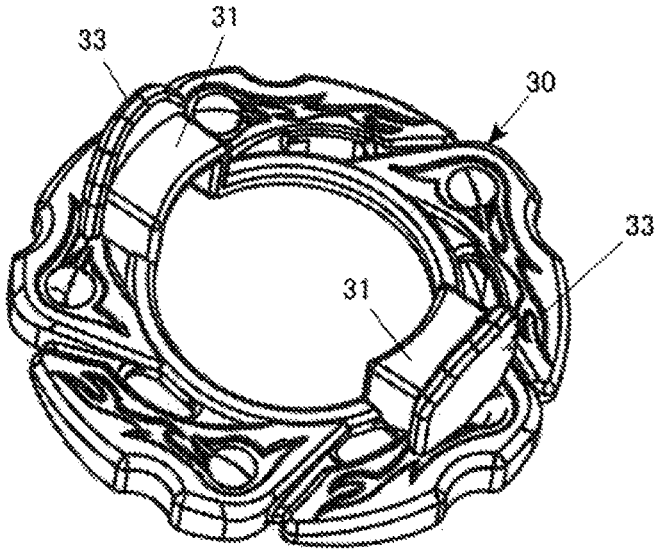
FIG. 4 is a perspective view showing a flywheel of the spinning top toy according to the present embodiment.
Figure 5:
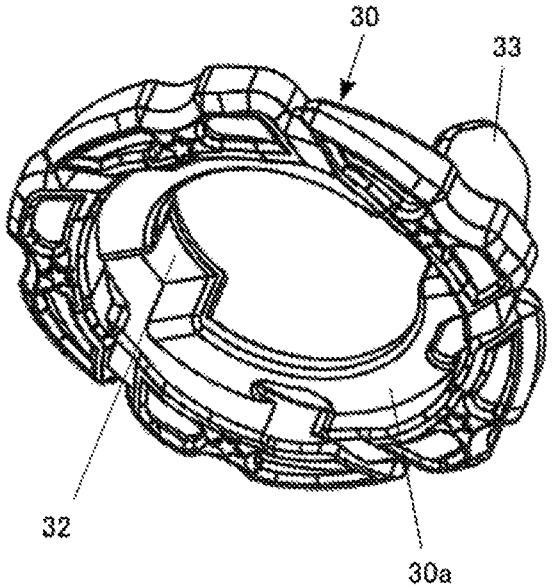
FIG. 5 is a perspective view showing a state in which the flywheel of the spinning top toy according to the present embodiment is viewed from lower side.

FIG. 4 is a perspective view showing a flywheel 30 when viewed from the upper side. FIG. 5 is a perspective view showing the flywheel 30 when viewed from the lower side.

The flywheel 30 is formed in an annular shape. At the inner periphery side of the bottom surface of the flywheel 30, an annular step part 30*a*, which can store the flange 12 of the shaft part 10 from the lower side, is formed. A projection part 31, which projects toward the upper side, is formed in each of the right and left of the upper surface of the flywheel 30. At the lower side part of each projection part 31, a recessed part 32, which can store the projection part 16 of the shaft part 10 from the lower side, is formed. Further, on the upper surface of the flywheel 30, a tongue-piece part 33, which extends upwardly, is formed directly outside of each of the projection parts 31. The tongue-piece parts 33 project higher than the projection parts 31.

3. Body 40

Figure 6:
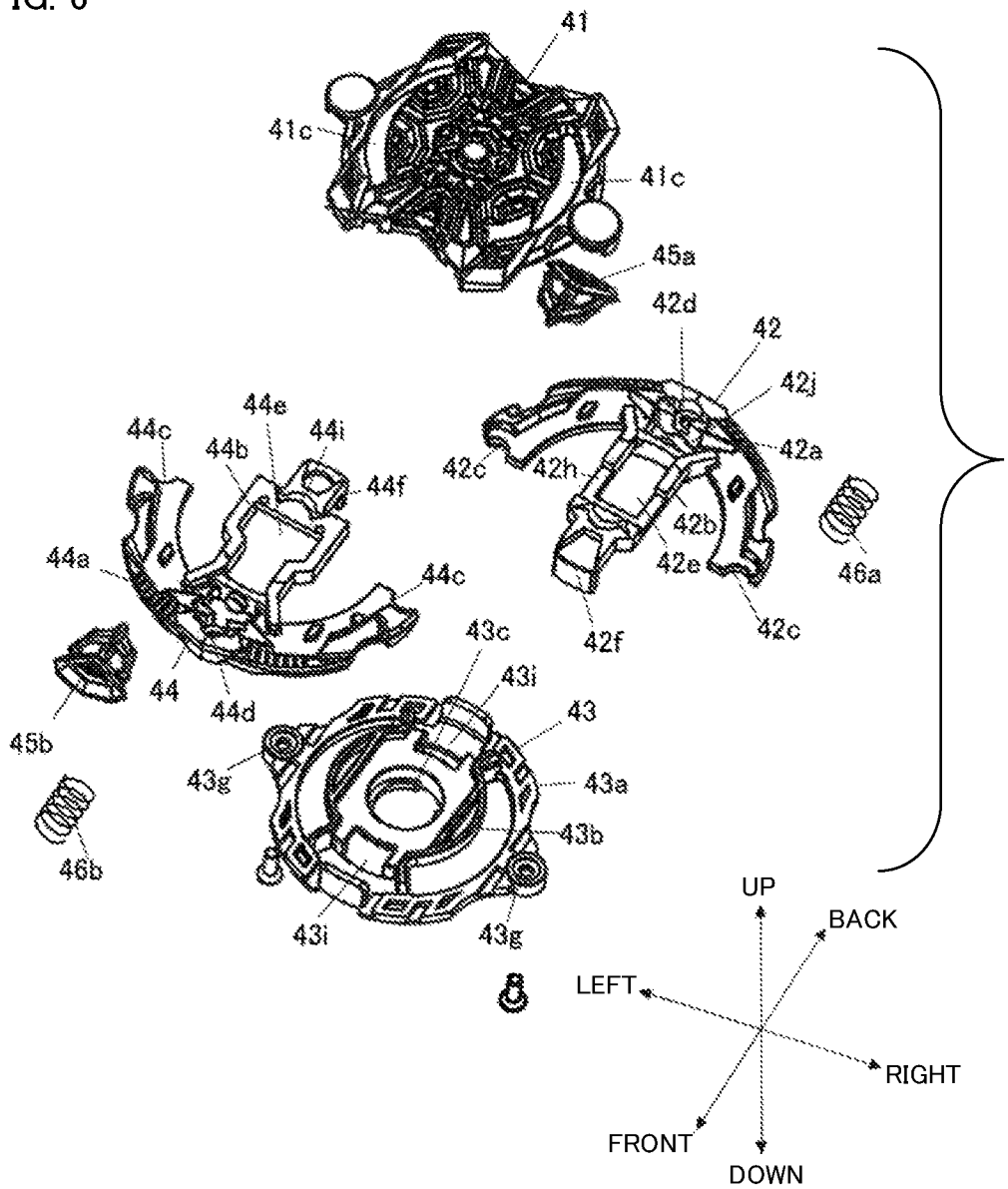
FIG. 6 is an exploded perspective view showing a state in which a body of the spinning top toy according to the present embodiment is viewed from the upper side.
Figure 7:
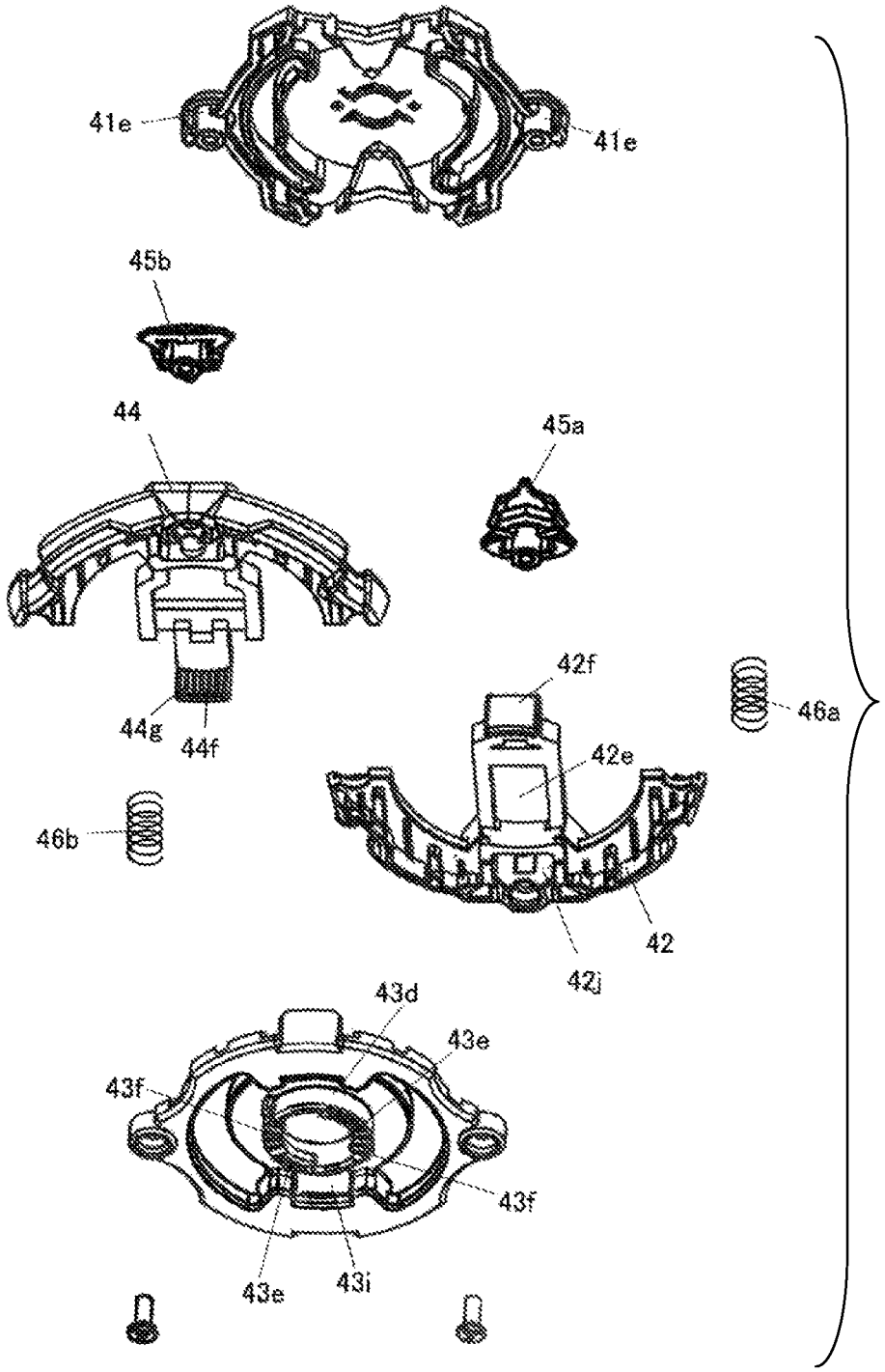
FIG. 7 is an exploded perspective view showing a state in which the body of the spinning top toy according to the present embodiment is viewed from the lower side.

FIG. 6 is an exploded perspective view showing the body 40 when viewed from the upper side. FIG. 7 is an exploded perspective view showing the body 40 when viewed from the lower side. The body 40 is provided with an upper plate 41, braking members 42, 44, and a lower plate 43. In the explanation of the body 40, the terms "up", "down", "left", "right", "front", and "back" refer to the corresponding directions in FIG. 6, unless otherwise stated.

(1) Upper Plate 41

At each of the right and left of an upper plate 41, an arcuate slit 41*c*, which is capable of inserting each tongue-piece part 33 of the flywheel 30 from the lower side, is formed. One end side of the width of each arcuate slit 41*c* in the circumferential direction is wider, and the other end side is narrower.

Further, at each of the right and left of the lower side of the upper plate 41, a cylindrical boss 41*e* is formed. A female screw is formed at the inner wall of a central hole of each boss 41*e*.

(2) Lower Plate 43

A lower plate 43 is provided with an annular frame body 43*a*. A coupling part 43*b*, which supports the fame body 43*a*, is provided inside the frame body 43*a*. A space between the fame body 43*a* and a coupling part 43*b* is the space for receiving the tongue-piece parts 33. At the center of the coupling part 43*b*, a hole 43*c* is formed. Further, at each of the right and left of the frame body 43*a*, a screw inserting hole 43*g* is provided. A counter sunk hole is provided in each of the upper and lower side of each inserting hole 43*g*. At the upper side of the counter sunk hole, the aforementioned boss 41*e* is placed. The body 40 is formed by sandwiching the braking members 42, 44 by the upper plate 41 and the lower plate 43 and by screwing the male screw (not shown) through the screw inserting hole 43*g* from the lower side so as to screw into the female screw of the boss 41*e*.

On the other hand, at the lower side of the lower plate 43, an annular wall 43*d*, of which the internal diameter is the same size as the diameter of the aforementioned hole 43*c*, is formed. At the inner surface of the lower end part of the annular wall 43*d*, in each of two sections which are faced across the shaft center, a hook 43*e* is formed to stretch inwardly in the radial direction. Further, at one end side of the lower surface of each hook 43*e* in the circumferential direction, raised parts 43*f*, which mesh with the aforementioned projections 20 of the shaft part 10, are formed. Here, the raised parts 43*f* are formed with a plurality of recessed parts which are continuously formed in the circumferential direction.

At each of the front and back of the lower plate 43, a hole 43*i*, which can receive a bent part 42*f*, 44*f* which will be described later, is formed.

(3) Braking Member 42

Figure 8:
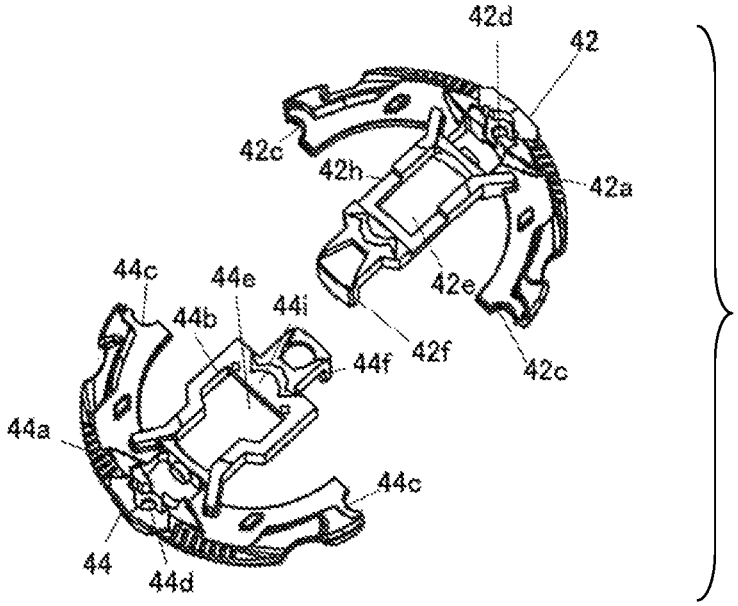
FIG. 8 is an exploded perspective view showing a state in which a braking member of the spinning top toy according to the present embodiment is viewed from the upper side.
Figure 9:
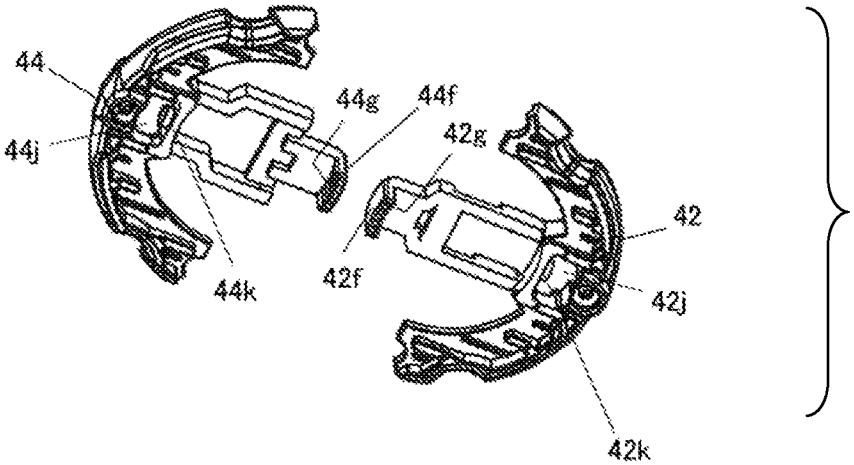
FIG. 9 is an exploded perspective view showing a state in which a braking member of the spinning top toy according to the present embodiment is viewed from the lower side.

FIG. 8 is an exploded perspective view showing braking members 42, 44 when viewed from the upper side. FIG. 9 is an exploded perspective view showing the braking members 42, 44 when viewed from the lower side. The braking members 42, 44 are formed substantially in an anchor shape.

The braking member 42 is provided with an arc shaped part 42*a*, which functions as a weight, and a slider piece 42*b* which projects inwardly in the radial direction from the central part of the inner periphery of the arc shaped part 42*a*. At the both ends of the arc shaped part 42*a*, a semicircular shaped notched part 42*c*, which fits into the outer periphery of the aforementioned boss 41*e*, is formed. Further, a screw inserting hole 42*d* is formed at the bottom inside the recessed part which is formed in the central part of the arc shaped part 42*a*. Therefore, a decoration part 45*a* is mounted to the braking member 42 by screwing a male screw (not shown) to a female screw (not shown) of the chevron-shaped decoration part 45*a* through the screw inserting hole 42*d* from the lower side.

In the slider piece 42*b*, a short hole 42*e* is formed. The top end of the slider piece 42*b* is bent downwardly, and at the inside of the bent part 42*f*, a raised part 42*g*, which is formed in a serrated shape, is formed. Further, at the both sides of the hole 42*e* of the slider piece 42*b*, a step part 42*h* is formed.

On the other hand, the braking member 44 is provided with an arc shaped part 44*a*, which functions as a weight, and a slider piece 44*b* which projects inwardly in the radial direction from the central part of the inner periphery of the arc shaped part 44*a*. At the both ends of the arc shaped part 44*a*, a semicircular shaped notched part 44*c*, which fits into the outer periphery of the aforementioned boss 41*e*, is formed. Further, a screw inserting hole 44*d* is formed inside the recessed part which is formed in the central part of the arc shaped part 44*a*. Therefore, a decoration part 45*b* is mounted to the braking member 44 by screwing a male screw (not shown) to a female screw (not shown) of the chevron-shaped decoration part 45*b* through the screw inserting hole 44*d* from the lower side.

In the slider piece 44*b*, a hole 44*e* is formed. The hole 44*e* includes a wide width part and a narrow width part. Further, the top end of the slider piece 44*b* is bent downwardly, and at the inside of the bent part 44*f*, a raised part 44*g*, which is formed as a serrated shape, is formed.

With such structure, the braking members 42, 44 are assembled each other as follows. That is, the braking member 42 and the braking member 44 are assembled each other in a way in which the bent part 44*f* is inserted into the hole 42*e* from the upper side, and the slider piece 44*b* of the braking member 44 is placed onto the slider piece 42*b* of the braking member 42. At this point, a lateral bar part 44*i*, which connects the edge parts of the both sides of the hole 44*e* of the braking member 44, is placed on the step part 42*h*.

Further, the size of the braking members 42, 44 will be described. When the braking members 42, 44 are assembled each other and mounted to the body 40, the arc shaped parts 42*a*, 44*a* constitute the external shape of the body 40, and the bent parts 42*f*, 44*f* are formed over the cylindrical body 13, so that it extends to the opposite side of the arc shaped parts 42*a*, 44*a*. With this structure, when the arc shaped parts 42*a*, 44*a* move outwardly in the radial direction by the centrifugal force, the raised parts 42*g*, 44*g* contact to the outer periphery of the cylindrical body 13.

Further, at the base end side of the braking member 42, a hole 42*j*, which is different from the hole 42*e*, is formed, and a spring 46*a* is installed between a wall of the hole 43*i* and a partition 42*k*, which partitions the hole 42*e* and the hole 42*j*. In a similar manner, at the base end side of the braking member 44, a hole 44*j*, which is different from the hole 44*e*, is formed, and a spring 46*b* is installed between a wall of the hole 43*i* and a partition 44*k*, which partitions the hole 44*e* and the hole 44*j*. Therefore, the raised parts 42*g*, 44*g* of the braking members 42, 44 installed to the body 40 are energized in the direction separating from each other. In this state, the raised parts 42*g*, 44*g* do not contact to the outer periphery of the cylindrical body 13 of the shaft part 10.

4. Assembly Method of Spinning Top Toy 1

Next, an assembly method of the spinning top toy 1 will be described. Here, it is assumed that the assembly of the shaft part 10 and the body 40 have been already finished as shown in FIG. 2.

First, the shaft part 10 and the flywheel 30 are assembled in the fitting state by matching the projection parts 16 of the shaft part 10 with the recessed parts 32 of the flywheel 30 from the lower side. Next, the assembled body is brought close to the body 40 from the lower side.

Then, the tongue-piece parts 33 of the flywheel 30 are inserted into the arcuate slits 41 of the body 40 from the lower side. In this state, the hooks 17 of the shaft part 10 and the hooks 43*e* of the body 40 are overlapped in the vertical direction. This state is the disassembled state. After that, the shaft part 10 of the aforementioned assembled body is pressed to the body 40 side. Then, the flywheel 30 is pressed against the lower surface of the body 40. Further, the spring 19 inside the shaft part 10 is contracted and the urging member 18 is lowered, so that the hooks 17 of the shaft part 10 are relatively pushed more upward than the hooks 43*e* of the body 40. The shaft part 10 is integrally rotated with the flywheel 30 in the predetermined direction (direction opposite to the rotation direction of the spinning top toy 1) with respect to the upper plate 41 and the lower plate 43. The hooks 43*e* of the body 40 slide into the lower side of the hooks 17 of the shaft part 10, so that it becomes the state in which the hooks 17 and the hooks 43*e* are overlapped in the vertical direction. When the shaft part 10 is released from hands, by the urging force of the spring 19 inside the shaft part 10, the lower surface of the hooks 17 of the shaft part 10 and the upper surface of the hooks 43*e* of the body 40 are contacted. In this state, that is, the state in which the lower surface of the hooks 17 of the shaft part 10 and the upper surface of the hooks 43*e* of the body 40 are contacted is the assembled state. With this, the projections 20 are meshed with the raised parts 43*f*, so that the spinning top toy 1 is assembled. In this state, the raised part 42*g* of the braking member 42 is urged in the direction separating from and the raised part 44*g* of the braking member 44 by the springs 46*a*, 46*b*, and thus, it is separated from the outer periphery of the cylindrical body 13.

5. How to Play, Etc.

Next, an example of how to play with the spinning top toy 1 will be described.

FIG. 1 is perspective view showing one example of a launcher which is used to launch and spin the spinning top toy 1.

In the example of how to play, by spinning the spinning top toy 1, a battle is performed with the spinning top toy 1 of the opponent.

In this case, a charge of the spinning force of the spinning top toy 1 is performed by the launcher 60 as shown in FIG. 1. In the inside part, the launcher 60 is provided with a disk which is not shown, and the disk is changed in one rotational direction by the power spring which is not shown. When the string, which is not shown, wound around the disk is pulled by a handle 61, the disk is rotated, and therefore, the spinning top holder 62 is rotated. The rotation of the spinning holder 62 is transmitted to the spinning top 1 by the forks 63 projecting downward, so that the spinning top toy 1 spins. In this case, the forks 63 are inserted to the arcuate slits 41*c* of the body part 40. When the handle 61 of the launcher 60 is pulled to the end, the rotation of the disk and further, the spinning top holder 62 is stopped, and on the other hand, the spinning top toy 1 is rotated further by the inertia force, so that the spinning top toy 1 is released from the spinning top holder 62 in accordance with the tilting faces 63*a* of the forks 63.

The spinning top toy 1, which is launched in such manner, has large centrifugal force at the beginning of the rotation, so that the arc shaped parts 42*a*, 44*a* of the braking members 42, 44 are moved outwardly in the radial direction. With this, the raised parts 42*g*, 44*g* are brought into pressure contact with the outer periphery of the cylindrical body 13 against the urging force of the spring 46*a*, 46*b* (see FIG. 10(B)). Therefore, even though the force in the direction opposite to the rotation direction of the shaft part 10 and the flywheel 30 is applied to the upper plate 41 and the lower plate 43 when the spinning top toy 1 collides with the opponent which rotates in the same direction, for example, and when the impact force is received due to the collision, it becomes hard for the upper plate 41 and the lower plate 43 to be relatively rotated in the direction opposite to the rotation direction of the shaft part 10 and the flywheel 30. Therefore, when the spinning top toy 1 collides with the opponent, not only the spinning top toy can give a strong impact to the opponent, but also obtaining longer time period until own spinning top toy 1 is disassembled. Further, in the present embodiment, in combination with this, the braking members 42, 44 become an offence member which stretches out outwardly in a radial direction at the time of operating. They project from the lower plate 43, and the offensive power can further increase.

On the other hand, in the later period of time of the rotation, the centrifugal force becomes small, so that the pressure contact force to the outer periphery of the cylindrical body 13 of the raised parts 42*g*, 44*g* becomes weak (see FIG. 10(A)). Therefore, when the force in the direction opposite to the rotation direction of the shaft part 10 and the flywheel 30 is applied to the upper plate 41 and the lower plate 43 at the time that the spinning top toy 1 collides with the opponent which rotates in the same direction, for example, and the impact force is received due to the collision, it becomes easy for the upper plate 41 and the lower plate 43 to be relatively rotated in the direction opposite to the rotation direction of the shaft part 10 and the flywheel 30.

With such structure, the characteristics of the spinning top toy 1 can be changed from the time of beginning of rotation to the later period of time of the rotation.

The embodiments of the present invention were described above, but the present invention is not limited to the aforementioned embodiments, and needless to say, various modifications may be made within the scope that does not depart from the essential point of the present invention.

For example, in the embodiments, the braking members 42, 44 are arranged in the body 40, and the raised parts 42*g*, 44*g* are faced to the cylindrical body 13 of the shaft part 10. However, the braking members 42, 44 may be arranged in the shaft part 10, and the raised parts 42*g*, 44*g* may be faced to the periphery wall of the body 40.

Further, the raised parts 42*g*, 44*g* are used as a pressure contacting part, but in addition to that, the pressure contacting part may be made by a material having large frictional resistance, or a rough surface may be provided, or a sheet having high frictional resistance material may be applied.

Further, in the embodiments, the braking members 42, 44 are configured to project from the body (lower plate 43 or upper plate 41) at the time of operating, but at first, it may be hidden in the body, so that only at the time of operation, it may project from the body. In addition, the braking members 42, 44 may be hidden even at the time of operation.

Further, in the embodiments, two braking members 42, 44 are provided, but it may be one or more than three.

Further, in the embodiments, the raised part 42*g* of the braking member 42 is urged in the direction separating from the raised part 44*g* of the braking member 44 by the springs 46*a*, 46*b*, but the springs 46*a*, 46*b* may be omitted. In addition, a spring may be installed between the braking member 42 and the braking member 44.

Further, in the embodiments, the raised parts 42*g*, 44*g* are provided in the braking members 42, 44 side, but it may be provided in the cylindrical body 13 side or both sides.

The terms and descriptions used herein are used only for explanatory purposes and the present invention is not limited to them. Accordingly, the present invention allows various design-changes falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, the terminology "present invention" or "invention" is meant as a non-specific, general reference and may be used as a reference to one or more aspects within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features.

EFFECT OF THE INVENTION

According to the aforementioned spinning top toy, at the time of beginning of rotation in which the centrifugal force is large, the braking member is brought into pressure contact with one of the shaft part or the body so as to suppress the rotation of the body with respect to the shaft part. As a result, the time period until the shaft part and the body are disassembled becomes longer, and at the beginning of rotation, the relative rotation between the shaft part and the body becomes hard, so that the offensive power is enhanced. Further, if this is the one in which the braking member stretches out outwardly in a radial direction at least at the time of operation so as to be operated as an offence member, the external shape of the spinning top toy expands, so that the offensive power further increases.

What is claimed is:

1. A spinning top toy for colliding against an opponent spinning top toy, the spinning top comprising:

a braking member;

a shaft part being configured to be rotated; and a body being detachably attached to the shaft part, the body being configured to be detached from the shaft part by being rotated with respect to the shaft part, when an impact is applied to the body, the braking member being configured on one of the shaft part and the body, and being movable by a centrifugal force, when urged by the centrifugal force, the braking member being configured to become in contact with the shaft part, if the braking member is configured on the body, when urged by the centrifugal force, the braking member being configured to become in contact with the body, if the braking member is configured on the shaft part.

2. The spinning top toy according to claim 1, wherein the body is gradually rotated with respect to the shaft part by receiving the impact.

3. The spinning top toy according to claim 1, wherein the body is configured to be detached from the shaft part when rotated in a first direction, and the body is assembled to the shaft part when rotated in a second direction opposite to the first direction.

4. The spinning top toy according to claim 1, wherein the braking member extends outwardly in a radial direction, and the braking member is configured to be in contact with the opponent spinning top toy when the spinning top toy is rotated.

5. The spinning top toy according to claim 1, wherein the braking member is movable in a third direction away from the shaft part, if the braking member is configured on the body, and the braking member becomes in contact with the body when moved in a fourth direction opposite to the third direction, if the braking member is configured on the shaft part.

* * * * *